United States Patent [19]

Qualitz et al.

[11] 4,417,752

[45] Nov. 29, 1983

[54] PRESSURE-SENSITIVE COPYING MATERIAL

[76] Inventors: Marion Qualitz, Hoffeldstr. 70, D-4010 Hilden; Viktor A. Krupp, Chopinstr. 12, D-4000 Düsseldorf, both of Fed. Rep. of Germany

[21] Appl. No.: 346,746

[22] Filed: Feb. 8, 1982

[30] Foreign Application Priority Data

Feb. 28, 1981 [DE] Fed. Rep. of Germany ..... 3107707

[51] Int. Cl.[3] ..... B41M 5/22

[52] U.S. Cl. ..... 282/27.5; 427/152; 428/320.4; 428/341; 428/342; 428/488; 428/914

[58] Field of Search ..... 106/31; 282/27.5; 427/150, 151, 152, 153; 428/211, 320.4, 488, 537, 913, 914, 341, 342

[56] References Cited

FOREIGN PATENT DOCUMENTS 2019467 10/1979 United Kingdom ..... 282/27.5

*Primary Examiner*—Bruce H. Hess

*Attorney, Agent, or Firm*—Schwartz, Jeffery, Schwaab, Mack, Blumenthal & Koch

[57] ABSTRACT

The present invention relates to a sheet-form or web-form copying material having an improved shelf life. More particularly, the invention relates to that part of copying materials of the type in question which contains the dye precursor by providing a new type of binder which may be used in conjunction with a variety of known dye precursors. Applied to the support material, it forms a unit of the pressure-sensitive copying material which, in combination with a plurality of known units containing dye acceptor material, forms pressure-sensitive copying material according to the invention.

8 Claims, No Drawings

PRESSURE-SENSITIVE COPYING MATERIAL

This invention relates to a sheet-form or web-form copying material having improved shelf life. More particularly, the invention relates to that part of copying materials of the type in question which contains the dye precursor by providing a new type of binder which may be used with a plurality of known dye precursors. After application to the support material, it forms a unit of the pressure-sensitive copying material which, in conjunction with a plurality of known units containing dye acceptor material, forms pressure-sensitive copying material according to the invention.

Pressure-sensitive copying papers according to the invention are known as chemical copying papers or carbonless papers. In general, they consist of a sheet-form or web-form unit containing a dye precursor or dye former or a solution thereof (the dye precursor being incorporated in or applied to the support material) and of a unit similarly containing the dye acceptor or dye developer which is capable of forming a dye by reaction with the dye precursor when the dye precursor or the solution thereof comes into contact with the dye acceptor under the effect of an external physical force, such as in particular pressure. In this way, a marking or drawing is produced in consistency with the external force applied. If the particular active substance in question is applied to the front of its web-form or sheet-form support material, the unit obtained is called a CF(coated front) sheet or web, the method of application being known as CF-coating. If the active substance is applied to the back of the support material, the unit obtained is called a CB (coated back) sheet or web, the method of application being known as CB-coating. A web-form or sheet-form support material containing one active substance (for example the dye precursor or dye former) on one side may be coated on its other surface with the other active substance (dye acceptor material) which, combined on both sides with correspondingly coated web-form or sheet-form support materials, gives a three-sheet copying material with which two copies can be simultaneously produced. Multiple-sheet sets for simultaneously producing an even larger number of copies may also be assembled in this way. Both the dye precursor and the dye acceptor material may be applied to the web-form or sheet-form material both by CB-coating and also by CF-coating.

In pressure-sensitive copying materials of the type hitherto available on the market, the dye precursor or dye former is generally applied to the web-form or sheet-form support material in the form of microcapsules—containing a solution of the dye precursor or dye former—of a solvent-resistant plastic and a suitable binder therefor. The capsules are applied in the form of capsule dispersions and the support material is dried after their application. However, a procedure such as this involves a number of process steps and requires complicated apparatus. In addition, the drying operation carried out after application of the capsule dispersions has a high energy consumption. Finally, the capsule papers are attended by the serious disadvantage that the solvents required for dissolving the dye precursors are generally physiologically harmful high-boiling solvents which are released when the unit of the pressure-sensitive copying material containing the dye former is printed on. Printing such as this occurs on a wide scale in the production of preprinted copying sets. The printers frequently complain of headache and nausea, which cannot always be prevented even with extraction systems. Numerous attempts have also been made to incorporate the dye precursors in a wax-like binder before they are applied to the web-form or sheet-form support material. Inspite of the numerous efforts which have been made, however, none of the binders used hitherto has proved successful. The properties of the binders used or of the mixture of binder and dye precursor were unsatisfactory. Not only should the binder adhere to the paper generally used as the support material, even after prolonged storage under a variety of temperature and humidity conditions, the binder and/or dye precursor should also not penetrate through the paper generally used as the support material, especially since in many cases the dye acceptor material is applied to the other side. Nor should the binder affect the properties of the paper in such a way that the paper loses its durability and tensile strength. Copying materials of this type are generally used for machine printing in high-speed machines. Finally, the coating obtained on the paper should also show such little surface adhesion that, when used in the machines, it does not adhere to the rollers used therein. In view of this multitude of required properties, no substitute for the expensive and environmentally unfavourable capsule papers has hitherto appeared on the market for applying the dye precursors to the web-form or sheet-form support material.

Propositions already have been made to substitute the microcapsules. According to these proposals, a particular binder is used to take up the dye precursor (see for instance GB No. 2 019 467 A). The proposed use of a binder consisting of a wax and softening agent or the use of similar combinations of waxes known as such with other softening agents known as such however does not produce practically useful pressure-sensitive copying materials. In some instances, the used waxes penetrate the paper foils used as carrier material after prolonged storage. In other cases, the copying materials do not have the necessary stability to storage under pressure, in that the copying material in the lower part of a stack thereof are coloured under the pressure produced by the weight of the part of the stack on top of the lower situated parts of the stack. In still other cases, the produced pressure-sensitive copying materials do not have the requested fastness to light and are generally discoloured.

Now, the object of the present invention is to provide a binder which binder consist of a very particular combination of a selected wax-like product, i.e. of an ester of a particular higher fatty acid with a particular high fatty alcohol or a mixture thereof with one or several other selected wax-like materials, on the one side, with a selected softening agent, i.e. the benzene pentadecane sulfonate and/or the corresponding cresol pentadecane sulfonate, or a mixture thereof with one or several selected other softening agents, on the other hand, but at least a combination of the above selected wax-like product and the above selected softening agent, in particular proportions to each other, and which binder may be applied with standard dye formers to the paper used as support material more easily than in the case of capsule papers and, thus, more readily to produce the dye-precursor containing unit of pressure-sensitive copying materials which, also in comparison to known copying material not using microcapsules, may be used without any of the disadvantages referred to in the foregoing and hence all in all to provide a pressure-sensitive copying material having an improved shelf life and fastness to light coupled enviromentally more favourable properties.

The pressure-sensitive copying material according to the invention, which consists of a unit containing a dye precursor and a unit containing a dye acceptor material which is capable of forming a dye by reaction with the dye precursor or of a corresponding multiple of these units, is characterised in that the support material of the unit containing the dye precursor is coated on one of its surfaces with an intimate mixture of from 7 to 35% by weight of hexacosanic acid-1-triacontanol ester or hexacosanic acid-1-hentriacontanol ester, from 0 to 18% by weight of a mixture of esters of higher aliphatic carboxylic acids and higher aliphatic alcohols, the mixture having a predominant content of nonacosanic acid esters of aliphatic alcohols containing from 12 to 30 carbon atoms in the alcohol radical, from 0 to 30% by weight of a mixture of esters of one or more lower alkylene glycols containing from 2 to 4 carbon atoms and higher aliphatic, straight-chain or branched carboxylic acids, the mixture consisting predominantly of ethylene glycol and 1,4-butylene glycol esters of the straight-chain dotriacontanic acid in addition to up to 10% by weight of corresponding esters of one or more straight-chain or branched-chain carboxylic acids containing a total of 28 to 34 carbon atoms, from 0 to 25% by weight of a polyethylene wax having a dropping point of from 103° to 107° C. and a setting point of from 90° to 94°0 C., from 0 to 10% by weight of a low-pressure polyethylene having a dropping point of from 118° to 128° C. and a setting point of from 104° to 108° C., from 10 to 80% by weight of a phenol pentadecane sulfonate or cresol pentadecane sulfonate plasticiser product or a mixture thereof, from 0 to 21% by weight of a plasticizer product of phthalic acid polyesters of higher alkane diols, the plasticiser product having a cold setting point of −35° C. or lower and a density d20/4 of from 1.035 to 1.045 g/cc, from 0 to 8% by weight of a plasticiser product of essentially phthalic acid ethylene glycol polyesters in admixture with phthalic acid polyesters of higher alkane diols, the plasticiser product having a cold setting point of −20° C. or lower and a density d20/4 of from 1.090 to 1.100 g/cc, from 0 to 20% by weight of a standard, finely particulate filler and from 3 to 15% by weight of one or more dye precursors.

In the embodiment of copying materials such as these designed for the simultaneous production of a number of copies, the pressure-sensitive copying material consists not only of these two units, but also of one or more intermediate units which are coated on one side with the dye precursor and on the other side with the dye acceptor material.

The pressure-sensitive copying materials according to the invention not only have an improved shelf life and fastness to light and can be produced using simpler machines and far less energy, the coloured parts produced by the application of pressure to the copying material also remain distinct over prolonged periods, in other words the characters formed do not fade away, as is generally the case with known copying materials in which the dye precursor is applied to the support material in combination with a wax-like binder. This is a significant, additional surprising advantage of the pressure-sensitive copying materials obtained in accordance with the invention using the special product combination as binder for the dye precursor. The dyes formed also have the long-term stability required for documents, so that the characters formed on copies obtained in this way remain satisfactorily legible, even over the period of several years required for numerous types of documents.

In one particularly preferred embodiment of the pressure-sensitive copying material according to the invention which provides the unit containing the dye precursor with particularly favourable properties, the support material of this unit is coated on one of its surfaces with an intimate mixture of from 7 to 30% by weight of hexacosanic acid-1-triacontanol ester or hexacosanic acid-1-hentriacontanol ester, from 7 to 18% by weight of the ester mixture having a predominant content of nonacosanic acid esters, from 9 to 32% by weight of the ester mixture predominantly containing ethylene glycol and 1,4-butylene glycol esters, from 0 to 10% by weight of the polyethylene wax, from 0 to 10% by weight of the low-pressure polyethylene, from 15 to 40% by weight of a mixture of the phenol pentadecane sulfonate and cresol pentadecane sulfonate plasticiser product, from 3 to 17% by weight of the phthalic acid polyester plasticiser product having a cold setting point of −35° C. or lower, from 0 to 8% by weight of the phthalic acid polyester plasticiser product having a cold setting point of −20° C. and lower and from 5 to 7% by weight of one or more dye precursors.

Good results are also obtained with a coating of somewhat simpler composition, namely a mixture of from 7 to 30% by weight of hexacosanic acid-1-triacontanol ester or hexacosanic acid-1-hentriacontanol ester, from 2 to 10% by weight of the ester mixture predominantly containing nonacosanic acid esters, from 45 to 80% by weight of a mixture of the phenol pentadecane sulfonate and cresol pentadecane sulfonate plasticiser product, from 0 to 5% by weight of the phthalic acid polyester plasticiser product having a cold setting point of $\leqq -20°$ C., from 3 to 15% by weight of one or more dye precursors.

If a filler is added to and mixed with the coating containing the dye precursor, it is of particular advantage for the support material to be coated on one of its surfaces with an intimate mixture of from 25 to 30% by weight of hexacosanic acid-1-triacontanol ester of hexacosanic acid-1-hentriacontanol ester, from 5 to 10% by weight of the ester mixture predominantly containing nonacosanic acid esters, from 5 to 10% by weight of the ester mixture predominantly containing ethylene glycol and 1,4-butylene glycol esters, from 0 to 3% by weight of the polyethylene wax, the low-pressure polyethylene or a mixture thereof, from 30 to 50% by weight of a mixture of the phenol pentadecane sulfonate and cresol pentadecane sulfonate plasticiser product, from 0 to 5% by weight of the phthalic acid polyester having a cold setting point of −35° C. or lower, the phthalic acid polyester having a cold setting point of −20° C. or lower or a mixture of both phthalic acid polyesters, from 5 to 20% by weight of a standard, finely particulate filler and from 6 to 10% by weight of one or more dye precursors.

Although particularly good results are obtained in this way, the optimal results both in regard to the properties of the copying material thus produced and in regard to the process for its production can best be obtained when the binder, optionally in addition to other constituents and in addition to the ever-present cerotic acid myricyl ester (n-hexacosanic acid-1-triacontanol or hentriacontanol ester; cf. Rompps Chemie-Lexikon, 7th Edition (1974) under cerotic acid and myricyl alcohol) in highly pure form, optionally containing less than 1% of free tetracosanic acid, and also the other two ester mixtures of higher aliphatic carboxylic acids with higher aliphatic alcohols or with alkylene diols are present in the quantitative ratios indicated in the foregoing, i.e. in the absence of fillers. Accordingly, it is particularly preferred in accordance with the invention to use these binders for the dye precursors and for the products produced therewith.

The binders used in accordance with the invention for the dye precursors may be used with particular good results for coating the CB-side of the support materials. To this end, they may be applied to the support material of the unit containing the dye precursor in quantities of from 1 to 10 g/m$^2$. The binder/dye precursor mixture is preferably applied in a quantity of from 2 to 4 g/m$^2$.

However, the binder/dye precursor mixture used in accordance with the invention may also be applied to the CF-side of the support material of the unit of the pressure-sensitive copying materials which contains the dye precursor. In this case, however, the quantities applied are generally somewhat smaller than those used for CB-coating, amounting to between 1 and 2 g/m$^2$ for the binders used in accordance with the invention.

In cases where it is desired to produce pressure-sensitive copying materials intended for use in tropical climates, it is of advantage to improve the properties of the unit of the pressure-sensitive copying materials which contains the dye precursor by coating the layer containing the dye precursor with a vinyl pyrrolidone/vinyl acetate copolymer in a quantity of at most 0.5 g/m$^2$ and/or with a polyvinyl pyrrolidone in a quantity of at most 0.2 g/m$^2$, which may be done by spraying on the two products from suitable solvents and drying the coated units obtained. For example, the vinyl pyrrolidone/vinyl acetate copolymer, which preferably consists of 20% of vinyl pyrrolidone and 80% of vinyl acetate, may be sprayed on from a 50% solution in ethanol whilst the polyvinyl pyrrolidone may be sprayed on from a 40% aqueous solution.

Numerous chromogenic products of the type commonly used in pressure-sensitive copying materials may be used as the dye precursors or dye formers. Examples of products such as these are dye precursors of the phthalide and fluorane type, such as for example crystal violet lactone, indole-substituted promellitides, leucoauramines, benzospiropyrans (cf. for example DE-PS No. 1,421,393), benzofuran derivatives (cf. for example DE-PS No. 1,421,394) or pyridine carboxylic acid lactones (cf. for example DE-PS No. 2,412,640). Particularly good results are obtained with dye precursors of the phthalide and fluorane type or with mixtures of both types, so that the use of dye precursors such as these in the copying materials according to the invention is particularly preferred. To improve the depth of colour, the dye precursors may optionally be used in admixture with benzoyl leucomethylene blue.

Suitable fillers are the standard commercial fillers for products of the type in question, such as for example $CaCO_3$, $BaSO_4$ or $TiO_2$, $CaCO_3$ being preferred.

Many of the above-described advantages of the pressure-sensitive copying materials according to the invention are actually present in the dye-precursor-containing unit of these pressure-sensitive copying materials. They are sheet-form or web-form units in which the support material is coated on one of its surfaces with the described binder/dye precursor mixture. To provide the complete set of the pressure-sensitive copying material, units such as these may be combined with the unit containing the dye acceptor material. In this connection, the unit containing the dye precursor may be combined with virtually any of the known units containing dye acceptor material to form copying sets having the advantageous properties mentioned above. Particularly favourable results are obtained with the units containing dye acceptor material which are described in German Patent Application Nos. P 30 09 754.2-45 and P30 09 806.7-45 filed 14.03.1980.

In cases where the units containing dye precursor according to the present invention are to be used in copying sets for the production of multiple copies, the support material of this unit is coated in the usual way, for example as described in the two above-mentioned German Patent Applications, with the described dye precursor/binder mixture on one of its surfaces and with a standard dye acceptor material on its other surface. In this connection, it is a particular advantage of the dye precursor/binder combination used in accordance with the invention that it does not penetrate into and through the support material, which generally consists of paper, thereby initiating a premature reaction with the dye acceptor material, even when the copying sets produced in accordance with the invention are stacked one on top of the other in relatively large numbers, i.e. under considerable pressure.

The pressure-sensitive copying materials according to the invention or rather the units of pressure-sensitive copying materials containing dye precursor according to the present invention may be produced particularly easily by heating some or all of the wax components of the mixture, i.e. the various esters of higher aliphatic carboxylic acids and/or higher aliphatic alcohols or alkane diols, to form a melt, adding the remaining components of the mixture and grinding the mixture until its various components are sufficiently fine, subsequently applying the mixture obtained as a melt to one side of the support material of the unit containing dye precursor in a quantity of from 1 to 10 g/m$^2$, if desired spraying on and drying the above-described solution of vinyl pyrrolidone/vinyl acetate copolymer and/or polyvinyl pyrrolidone and cooling the resulting unit containing dye precursor. If this unit is not itself a standard commercial product, it may be further processed in the usual way. Thus, to produce dye-precursor-containing units for copying sets intended for the production of multiple copies, dye acceptor material may be applied in the usual way to the back or alternatively the unit containing dye precursor may be combined with the unit containing dye acceptor material, the dye-precursor-containing surface of one unit being arranged adjacent the dye-acceptor-containing surface of the other unit to form pressure-sensitive copying material according to the invention. However, these process steps are well known to the expert and are described in detail in the relevant literature, to which reference is made.

The invention is illustrated by but by no means limited to the following Examples.

EXAMPLES 1 to 12

Description of the products used in the Examples

(a) Waxes

Product I=cerotic acid myricyl ester (n-hexacosanic acid-1-triacontanol or hentriacontanol ester containing less than 1% of free tetracosanic acid).

Product II = an ester mixture predominantly containing nonacosanic acid esters of higher aliphatic alcohols and having a melting point of 86° C., a setting point of 78° C. according to DGF-M-III-4a, a penetration number of 1 according to DIN 51579, an acid number of 32 according to DGF-M-IV-2 and a saponification number of 92 according to DGF-M-IV-2.

Product III = an ester mixture predominantly containing ethylene and 1,4-butylene glycol esters of linear dotriacontanic acid with up to 10% by weight of the corresponding esters of linear or branched carboxylic acids containing a total of from 28 to 34 carbon atoms, the ester mixture having a dropping point of from 81° to 86° C. according to DGF-M-III-3, an acid number of from 20 to 30 according to DGF-M-IV-2, a saponification number of from 130 to 150 according to DGF-M-IV-2 and a penetration number of 1 according to DIN 51579.

Product IV = a polyethylene wax having a dropping point of from 103° to 107° C. according to DGF-M-III-3, a setting point of from 90° to 94° C. according to DGF-M-III-4a, an acid number of 0 according to DGF-M-IV-2, a saponification number of 0 according to DGF-M-IV-2 and a penetration number of from 3 to 5 according to DIN 51579.

Product V = a low-pressure polyethylene having a dropping point of 118° to 128° C. according to DGF-M-III-3, a setting point of from 104° to 108° C. according to DGF-M-III-4a, an acid number of 0 according to DGF-M-IV-2, a saponification number of 0 according to DGF-M-IV-2 and a penetration number of from 2 to 4 according to DIN 51579.

(b) Plasticiser

Product VI = a mixture of phenol and cresol pentadecane sulfonates, the mixture having a density d20/4 of from 1.030 to 1.070 g/cc according to DIN 51757, a refractive index nD of 14.970 to 15.000 according to DIN 53491, a cold setting point of $\leqq -15°$ C. according to DIN 51583 and a Brabander volatility (0–72h/90° C.) of $\leqq 2.0\%$).

Product VII = a phthalic acid polyester of higher alkane diols having a density d20/4 of from 1.035 to 1.045 g/cc according to DIN 51757, a refractive index nD of from 1.502 to 1.504 according to DIN 53491, a cold setting point of $\leqq -35°$ C. according to DIN 51583 and a Brabander volatility (0–72h/90° C.) of $\leqq 1.1\%$.

Product VIII = a phthalic acid polyester of essentially ethylene glycol in addition to higher alkane diols having a density d20/4 of from 1.090 to 1.100 g/m$^3$ according to DIN 51757, a refractive index nD of from 1.503 to 1.505 according to DIN 53491, a cold setting point of $\leqq -20°$ C. according to DIN 51583 and a Brabander volatility (0–72h/90° C.) of $\leqq 2.0\%$.

General procedure

The molten waxes are introduced into a bead mill heated to approximately 110° C. Thereafter all the other constituents of the mixture are added and the mixture as a whole is ground to a fineness of approximately 6 μm.

The mixture obtained is applied from the melt by spread coating, spot coating or screen printing to all or part of the underneath (CB-side) of a 17 to 80 g/m$^2$ sheet-form or web-form support paper in a quantity of 4 g/m$^2$ of area coated. The product mixture according to Example 12 was also used for application to the front (CF side) of a sheet of paper, being applied in a quantity of 2 g/m$^2$ of area coated.

EXAMPLE 1

| % by weight | Constituent |
|---|---|
| 7.4 | product I |
| 8.3 | product II |
| 31.3 | product III |
| 9.2 | product IV |
| 35.0 | product VI |
| 3.7 | product VII |
| 0.6 | rhodamine-b-lactone |
| 2.8 | crystal violet lactone |
| 1.7 | malachite green lactone |

EXAMPLE 2

| % by weight | Constituent |
|---|---|
| 27.8 | product I |
| 5.6 | product III |
| 25.0 | product IV |
| 13.9 | product VI |
| 19.4 | product VII |
| 4.2 | crystal violet lactone |
| 4.1 | rhodamine-b-lactone |

EXAMPLE 3

| % by weight | Constituent |
|---|---|
| 34.3 | product I |
| 3.0 | product V |
| 33.2 | product VI |
| 21.0 | product VII |
| 0.6 | rhodamine-b-lactone |
| 5.3 | crystal violet lactone |
| 2.4 | malachite green lactone |

EXAMPLE 4

| % by weight | Constituent |
|---|---|
| 30.0 | product I |
| 55.7 | product VI |
| 3.1 | product VII |
| 2.7 | product VIII |
| 4.9 | crystal violet lactone |
| 2.6 | malachite green lactone |
| 0.3 | rhodamine-b-lactone |

EXAMPLE 5

| % by weight | Constituent |
|---|---|
| 24.4 | product I |
| 7.7 | product II |
| 9.0 | product III |
| 8.9 | product V |
| 19.2 | product VI |
| 16.8 | product VII |
| 8.0 | product VIII |
| 6.2 | 3-diethylamino-6-methyl-7-anilinofluorane |

EXAMPLE 6

| % by weight | Constituent |
|---|---|
| 7.8 | product I |

-continued

| % by weight | Constituent |
|---|---|
| 10.9 | product II |
| 78.3 | product VI |
| 1.0 | crystal violet lactone |
| 1.0 | benzoyl leucomethylene blue |
| 1.0 | rhodamine-b-lactone |

EXAMPLE 7

| % by weight | Constituent |
|---|---|
| 28.6 | product I |
| 9.5 | product II |
| 47.6 | product VI |
| 14.3 | crystal violet lactone |

EXAMPLE 8

| % by weight | Constituent |
|---|---|
| 30.0 | product I |
| 2.0 | product II |
| 56.0 | product VI |
| 5.0 | product VIII |
| 7.0 | rhodamine-b-lactone |

EXAMPLE 9

| % by weight | Constituent |
|---|---|
| 24.0 | product I |
| 18.0 | product II |
| 9.0 | product III |
| 39.0 | product VI |
| 4.0 | product VII |
| 2.0 | crystal violet lactone |
| 4.0 | dimethylamino-6-methyl-7-anilinofluorane |

EXAMPLE 10

| % by weight | Constituent |
|---|---|
| 28.0 | product I |
| 7.0 | product II |
| 25.0 | product III |
| 5.0 | product IV |
| 22.0 | product VI |
| 2.0 | rhodamine-b-lactone |
| 4.0 | crystal violet lactone |

EXAMPLE 11

| % by weight | Constituent |
|---|---|
| 26.5 | product I |
| 4.8 | product II |
| 9.1 | product III |
| 44.9 | product VI |
| 5.0 | calcium carbonate |
| 9.7 | crystal violet lactone |

EXAMPLE 12

| % by weight | Constituent |
|---|---|
| 18.0 | product I |
| 8.1 | product II |

-continued

| % by weight | Constituent |
|---|---|
| 7.3 | product III |
| 2.0 | product V |
| 34.5 | product VI |
| 3.6 | product VII |
| 20.0 | calcium carbonate |
| 6.5 | rhodamine-b-lactone |

What we claim is:

1. A pressure-sensitive copying material having improved shelf life and fastness to light and consisting of a support sheet or web coated with a dye precursor together with a binder therefor and of a support sheet or web containing a dye acceptor material which is capable of forming a dye by reaction with the dye precursor, characterised in that the support sheet or web containing the dye precursor is coated on one of its surfaces with an intimate mixture of from 7 to 35% by weight of hexacosanoic acid-1-triacontanol ester or hexacosanic acid-1-hentriacontanol ester, from 0 to 18% by weight of a mixture of esters of higher aliphatic carboxylic acids and higher aliphatic alcohols, the mixture having a predominant content of nonacosanic acid esters of aliphatic alcohols containing from 12 to 30 carbon atoms in the alcohol radical, from 0 to 30% by weight of a mixture of esters of one or more lower alkylene glycols containing from 2 to 4 carbon atoms and higher aliphatic, straight-chain or branched carboxylic acids, the mixture consisting predominantly of ethylene glycol and 1,4-butylene glycol esters of straight-chain dotriacontanic acid in addition to up to 10% by weight of corresponding esters of one or more straight-chain or branched-chain carboxylic acids containing a total of from 28 to 34 carbon atoms, from 0 to 25% by weight of a polyethylene wax having a dropping point of from 103° to 107° C. and a setting point of from 90° to 94° C., from 0 to 10% by weight of a low-pressure polyethylene having a dropping point of from 118° to 128° C. and a setting point of from 104° to 108° C., from 10 to 80% by weight of a plasticizer selected from the group consisting of phenol pentadecane sulfonate, cresol pentadecane sulfonate, and mixtures thereof, from 0 to 21% by weight of a plasticiser selected from the group consisting of phthalic acid polyesters of higher alkane diols, the plasticiser having a cold setting point of −35° C. or lower and a density d20/4 of from 1.035 to 1.045 g/cc, from 0 to 8% by weight of a plasticiser selected from the group consisting of phthalic acid polyesters of higher alkane diols, the plasticiser having a cold setting point of −20° C. or lower and a density d20/4 of from 1.090 to 1.100 g/cc, from 0 to 20% by weight of a finely particulate filler and from 3 to 15% by weight of one or more dye precursors.

2. A pressure-sensitive copying material as claimed in claim 1, characterised in that the support material of the unit containing the dye precursor is coated on one of its surfaces with an intimate mixture of from 7 to 30% by weight of hexacosanic acid-1-triacontanol ester or hexacosanic acid-1-hentriacontanol ester, from 7 to 18% by weight of the ester mixture having a predominant content of nonacosanic acid esters, from 9 to 32% by weight of the ester mixture having a predominant content of the ethylene glycol and 1,4-butylene glycol esters, from 0 to 10% by weight of the polyethylene wax, from 0 to 10% by weight of the low-pressure polyethylene, from 15 to 40% by weight of a mixture of the phenol pentadecane sulfonate and the cresol pentadecane sulfonate plasticiser, from 3 to 17% by weight of the phthalic acid polyester plasticiser having a cold setting point of −35° C. or lower, from 0 to 8% by weight of the phthalic acid polyester plasticiser having a cold setting point of −20° C. or lower and from 5 to 7% by weight of one or more dye precursors.

3. A pressure-sensitive copying material as claimed in claim 1, characterised in that the support material of the unit containing the dye precursor is coated on one of its surfaces with an intimate mixture of from 7 to 30% by weight of hexacosanic acid-1-triacontanol ester or hexacosanic acid-1-hentriacontanol ester, from 2 to 10% by weight of the ester mixture having a predominant content of nonacosanic acid esters, from 45 to 80% by weight of a mixture of the phenol pentadecane sulfonate and the cresol pentadecane sulfonate plasticiser, from 0 to 5% by weight of the phthalic acid polyester plasticiser having a cold setting point of ≦−20° C., from 3 to 15% by weight of one or more dye precursors.

4. A pressure-sensitive copying material as claimed in claim 1, characterised in that the support material of the unit containing the dye precursor is coated on one of its surfaces with an intimate mixture of from 25 to 30% by weight of hexacosanic acid-1-triacontanol ester or hexacosanic acid-1-hentriacontanol ester, from 5 to 10% by weight of the ester mixture having a predominant content of nonacosanic acid ester, from 5 to 10% by weight of the ester mixture having a predominant content of ethylene glycol and 1,4-butylene glycol esters, from 0 to 3% by weight of the polyethylene wax, the low-pressure polyethylene or a mixture thereof, from 30 to 50% by weight of a mixture of the phenol pentadecane sulfonate and the cresol pentadecane sulfonate plasticiser, from 0 to 5% by weight of the phthalic acid polyester having a cold setting point of −35° C. or lower, the phthalic acid polyester having a cold setting point of −20° C. or lower or a mixture of both phthalic acid polyesters, from 5 to 20% by weight of a, finely particulate filler and from 6 to 10% by weight of one or more dye precursors.

5. A pressure-sensitive copying material as claimed in claim 1, characterised in that the mixture applied to one of the surfaces of the support sheet or web containing the dye precursor is applied to the CB-side of the support sheet or web.

6. A pressure-sensitive copying material as claimed in claim 1, characterised in that the intimate mixture containing the dye precursor is applied to the support sheet or web in a quantity of from 1 to 4 g/m$^2$.

7. A pressure-sensitive copying material as claimed in claim 1, characterised in that the dye precursor used is a dye precursor of the phthalide and/or fluorane type, optionally in admixture with benzoyl leucomethylene blue.

8. A pressure-sensitive copying material as claimed in claim 1, characterised in that the layer containing the dye-precursor is coated with a vinyl pyrrolidone/vinyl acetate copolymer in a quantity of at most 0.5 g/m$^2$ and/or with a polyvinyl pyrrolidone in a quantity of at most 0.2 g/m$^2$.

* * * * *